US009096071B2

(12) United States Patent
Lint

(10) Patent No.: US 9,096,071 B2
(45) Date of Patent: Aug. 4, 2015

(54) DOT DETECTION METHOD AND COLOR IMAGE REPRODUCTION APPARATUS

(71) Applicant: OCE-TECHNOLOGIES B.V., Venlo (NL)

(72) Inventor: Alexander Lint, Veldhoven (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/475,059

(22) Filed: Sep. 2, 2014

(65) Prior Publication Data

US 2015/0049137 A1 Feb. 19, 2015

Related U.S. Application Data

(63) Continuation of application No. PCT/EP2013/053402, filed on Feb. 21, 2013.

(30) Foreign Application Priority Data

Mar. 2, 2012 (EP) ..... 12157846

(51) Int. Cl.
*B41J 2/205* (2006.01)
*B41J 2/21* (2006.01)

(52) U.S. Cl.
CPC ..... *B41J 2/2132* (2013.01); *B41J 2/2142* (2013.01); *B41J 2/205* (2013.01)

(58) Field of Classification Search
CPC ..... H04N 1/60; H04N 1/00681; H04N 1/642; H04N 1/6094; B41J 2/21; B41J 2/2135; B41J 2/2142; B41J 2/2132; B41J 2/205
USPC ..... 347/15
See application file for complete search history.

(56) References Cited

U.S. PATENT DOCUMENTS

| | | | | |
|---|---|---|---|---|
| 4,907,013 | A * | 3/1990 | Hubbard et al. | 347/19 |
| 5,353,130 | A * | 10/1994 | Hasegawa | 358/530 |
| 6,118,552 | A * | 9/2000 | Suzuki et al. | 382/166 |
| 6,419,340 | B1 | 7/2002 | Wickham et al. | |
| 6,561,643 | B1 | 5/2003 | Walker et al. | |
| 2003/0132366 | A1 | 7/2003 | Gao et al. | |
| 2010/0123914 | A1 | 5/2010 | Uwatoko et al. | |

FOREIGN PATENT DOCUMENTS

| | | | |
|---|---|---|---|
| WO | WO 01/39486 | A1 | 5/2001 |
| WO | WO 02/076752 | A1 | 10/2002 |
| WO | WO 2009/014537 | A1 | 1/2009 |

* cited by examiner

*Primary Examiner* — Alessandro Amari
*Assistant Examiner* — Michael Konczal
(74) *Attorney, Agent, or Firm* — Birch, Stewart, Kolasch & Birch, LLP

(57) ABSTRACT

A method for detecting a dot of functional material on a medium at a predetermined location, the dot having a predetermined color, is based on lightness, chroma and hue components of colors present in an area of the predetermined location on a scanned image of the printed medium. A color image reproduction apparatus is disclosed for carrying out the method for detecting a dot of functional material.

7 Claims, 5 Drawing Sheets

DOT DETECTION METHOD AND COLOR IMAGE REPRODUCTION APPARATUS

CROSS-REFERENCE TO RELATED APPLICATIONS

This application is a Continuation of International Application No. PCT/EP2013/053402, filed on Feb. 21, 2013, and for which priority is claimed under 35 U.S.C. §120. PCT/EP2013/053402 claims priority under 35 U.S.C. §119(a) to Application No. 12157846.2, filed in Europe on Mar. 2, 2012. The entire contents of each of the above-identified applications are hereby incorporated by reference into the present application.

BACKGROUND OF THE INVENTION

1. Field of the Invention

The invention relates to a method for detecting a dot of functional material on a medium at a predetermined location, the dot having a predetermined color, wherein the method comprises the steps of determining an environment of the predetermined location, comprising a plurality of pixels surrounding the predetermined location and including the predetermined location itself, scanning the environment resulting in scanning values for each pixel of the environment, and for each pixel of the environment, establishing a value for a lightness component of a color of the pixel derived from the scanning values.

2. Description of Background Art

Image reproduction apparatuses are known, which are able to print jobs arriving at the image reproduction apparatus via a network or an analogue document via a scanner being part of the image reproduction apparatus. Such a job may contain an image or a text or both an image and a text in black-and-white format or in color format. The job entry in the image reproduction apparatus may be controlled by a controller, for example a computer, a control unit or a processor inside the image reproduction apparatus. Also the controller may convert image and text data into commands for the print unit to let the print elements eject functional material at the right location and the right time on the receiving material. The memory of the image reproduction apparatus comprises a work memory part for loading and modifying images and a save memory part for saving images. Instead of the term printing element, the term print element or nozzle may be used hereinafter.

However, nozzles may fail when they become clogged or are misdirecting.

Detectors are known, which can detect such a failing print element during printing or which can predict a high probability that a print element will fail in short time. The visibility of a failing print element on the receiving material depends on the print strategy. In a multi-pass approach, a failing print element appears typically less visible than in a single pass approach. In a multi-pass approach each pixel line is addressed by multiple print elements and a failing print element may be compensated for by filling in with another print element, for example in a later pass. However, such a print element failing correction for a multi-pass approach will not be possible in a single pass approach, where each pixel is addressed by only one print element.

In a single pass approach the failing print element immediately produces a light stripe in the print image on the receiving material and there is no chance to fill in this location later by means of another print element.

If one or more printing elements are detected as failing, a corrective action may be taken. The printing element failing detection may be applied on actual information of images which are to be printed, but may also be applied on spit patterns, which are additional to the actual information. A spit pattern is an arrangement of dots of functional material on the medium. The dots of the spit pattern are printed by different printing elements in order to check the state of the printing element, for example "ejecting" or "failing" may be a result of the detection.

Normally, the detection of a dot of a spit pattern is achieved by using a detector like a scanner, which can establish the lightness of a location on the medium, which is predetermined to receive the dot. Since the detector is less accurate, the spitting element is less accurate and the scanned image is smearing a dot over a larger area than one location, an environment of the predetermined location may be investigated and lightness components for each pixel in the environment may be established. A detector may use an RGB detection, an L*a*b* detection or an XYZ detection method. If a detector uses RGB detection, a channel out of the R, G and B channel may be selected for establishing the lightness. Which channel is used depends on the color of the functional material being measured. Using only a single channel for detection will deliver a reliable detection method. Normally a channel that provides the most contrast is selected.

A lightness based detector does not work well for all types of functional material like inks in combination with a medium. For example, magenta ink which by itself is already difficult to detect due to a poor contrast which it has in detector channels is very difficult to detect on paper with rough fibers and therefore with a strong fiber visibility on a scan file. For optimal operations, a detector must be balanced so that it only detects dots if they are present and must also give a negative result if no dot is present. As it turns out from experiments, for kinds of paper that have fibers in it that are visible in a scanned image of the paper, it is impossible to tune the detector so that it provides balanced results. This is due to the visibility of the fibers being present in such kind of paper. Either the detector is set to a value that magenta ink dots are found—but then there is large chance that the detector misfires on fibers in the paper—or the detector is set to a working point so that it does not trigger on the fibers in the paper—but in this case, the detector starts to miss a significant amount of magenta dots.

In other words, a disadvantageous result is that sometimes a dot is established that is not present or a dot is present that is not established. This leads also to a detection of a printing element that is not failing or to a non-detection of an actually failing printing element.

SUMMARY OF THE INVENTION

It is an object of the present invention to provide a method that improves the correct detection of whether or not a printing element is failing.

According to the present invention, this object is achieved by a method according to the preamble, wherein the method comprises the further steps of, for each pixel of the environment, establishing a chroma value for a chroma component of a color of the pixel derived from the scanning values, summarizing the chroma values of the pixels of the environment into a summarized chroma value for the environment, summarizing the lightness values of the pixels of the environment into a summarized lightness value for the environment, comparing the summarized chroma value to a predetermined chroma threshold value for the predetermined color of the dot, comparing the summarized lightness value to a predetermined lightness threshold value for the predetermined color of the dot, and deciding whether or not the dot is present in the environment based on both comparing steps.

The combination of establishing a lightness component and a chroma component of each pixel of the environment offers a more thorough analysis whether or not a printing element is failing. Such an analysis may consist of a first analysis of the lightness components of the pixels of the environment and a second analysis of the chroma components of the pixels of the environment. These two analysis combined deliver a more accurate decision of whether or not a printing element is failing.

For example, while magenta, cyan and yellow functional material dots have significant chroma content, fibers in paper do not have such a strong chroma content.

As an environment of the predetermined location, a kernel area of a first number of pixels in a first direction by a second number of pixels in a second direction being perpendicular to the first direction may be selected. The first number of pixels and the second number of pixels determine the size of the environment to be examined. The size may be determined by the degree to which a printing element, which has ejected a drop of function material delivering the detected dot, has an ejection deviation with respect to the predetermined location. Such a deviation may comprise two components, one component in the first direction and a second component in the second direction. The size of the first component may differ from the size of the second component. The first number of pixels and the second number of pixels may also depend on a resolution of the printing apparatus in the first and second direction. The size of the environment may also depend on the misalignment of the scanned image and the original image to be printed.

All chroma content within the given environment is summarized in order to do an outstanding analysis. A summarized chroma value for the environment has than to exceed a calibrated threshold value in order to return a positive result.

Moreover, a dot is only considered present when both the lightness detection and the chroma detection both return a positive result at the same environment of the predetermined location.

According to an embodiment, the method comprises the further steps of, for each pixel of the environment, establishing a hue value for a hue component of a color of the pixel derived from the scanning values, and only chroma values of the pixels of the environment are summarized, which pixels have a hue value for the hue component of the color of the pixel within a predetermined hue angle range for the predetermined color of the dot.

This is advantageous, since the summarizing of only chroma values, which have a hue value falling within the predetermined hue angle, improves the detection. Chroma values of pixels in the selected environment are summarized, provided that their corresponding hue values are within a predetermined hue angle range. The result is a summarized chroma value for the environment. The summarized chroma value has then to exceed a calibrated threshold in order to return a positive result. Moreover, a dot is only considered present when both the lightness detection and the chroma detection in combination with the hue detection both return a positive result at the same environment of the predetermined location. This allows the lightness detection to operate at very sensitive settings, since the chroma detection in combination with the hue detection rejects most locations where the paper fiber triggers the lightness detection.

According to an embodiment, the method comprises a further step of individually setting a chroma threshold and a hue angle range for each combination of a type of medium and a color of the functional material. A hue angle range and a chroma threshold are set individually for each type of medium in combination with each color of the functional material, like cyan ink, magenta ink and yellow ink. This is advantageous, since by doing so, different colors of ink drops can be distinguished for each type of medium.

According to an embodiment, the method comprises further steps of using a difference vector of a chroma value of a dot and a chroma value of the medium, instead of the established chroma value and a difference vector of a hue value of the dot and a hue value of the medium, instead of the established hue value The detection of chroma values is executed by using a delta chroma value relative to the chroma value of the medium, instead of the established chroma value and a delta hue value range relative to a hue value of the medium, instead of the established hue value. The delta chroma value may be an absolute difference between the established chroma value and the chroma component value of the medium. The delta hue value range may be an absolute difference between the established hue value angle range and the hue angle component value of the medium. For example, the chroma value and the hue value of paper white may be determined by building a histogram of the scanning data, and deriving the point of paper white in an L*a*b* color space from the histogram. This is advantageous, since according to this embodiment it is possible to detect combinations of functional material and media that were nearly undetectable before. For instance, the main time between failure of the detection is improved by a substantial large factor for magenta ink on paper with strong fiber components, using the smallest dot out of a range of possible dot sizes.

A detection of chroma and hue may be implemented in software as part of an overall printing element failure detection. Despite limited optimization only, an algorithm may be designed, which is fast enough to keep up with an image reproduction engine in the image reproduction apparatus.

According to an embodiment, the dot to be decided to be present or not, is part of a background spit pattern designed with respect to detection of a failure of a printing element in a color image reproduction apparatus, said printing element being suitable to eject the dot. Since the reproduction apparatus may reproduce images comprising different colors, the method according to the present invention may be used to distinguish dots of different colors from each other. In this way, it is possible to precisely detect, also due to the design of the background spit pattern, which printing element that ejects functional material of a certain color, is defective or not. Even if a dot of a different color is ejected by a printing element in another environment of a neighboring printing element suitable to eject another color of functional material, the color detection according to the present invention may be used to make the right decision for the colored dot to be present or not.

According to an embodiment, the method comprises a step of shifting the environment around in a larger area than the determined environment, which larger area comprises the determined environment, in order to search for a dot in each shifted environment.

If for example, the environment is a 3 by 3 kernel area, the larger area may be a 5 by 7 kernel area comprising the 3 by 3 kernel. The 3 by 3 kernel area may be shifted into 15 different positions in the larger area.

The present invention also relates to a method for detecting a plurality of dots of functional material on a medium at a predetermined location, each dot having a predetermined color, wherein each dot is detected according to any one of the methods of the preceding embodiments. The plurality of dots may form a line or any other geometrically defined shape.

The present invention also relates to a color image reproduction apparatus comprising printing elements for ejecting colored dots of functional material according to a digital color image on a medium having a medium color, a scanner configured to scan a location on the medium resulting in a scanned color, a first establishing mechanism configured to establish a lightness component of the scanned color, a second establishing mechanism configured to establish a chroma component of the scanned color, a third establishing mechanism configured to establish a hue component of the scanned color, and a decision mechanism configured to decide whether a colored dot is present on the medium in an environment of a location of the medium, which location is present in a list of predetermined dot locations residing in a memory of the color image reproduction apparatus, wherein a decision taken by the decision mechanism is based on each value of the established components of the scanned color. The ejected colored dots of functional material may form a background spitting pattern. Such a pattern is used to determine when a printing element of the color image reproduction apparatus is defective or not. The dots according to the locations in the list of predetermined dot locations may be integrated in the color image to be printed.

The present invention also includes a computer program embodied on a non-transitory computer readable medium and comprising computer program code to enable a color image reproduction apparatus according to the invention described here-above in order to execute the method according to any one of the embodiments described here-above.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
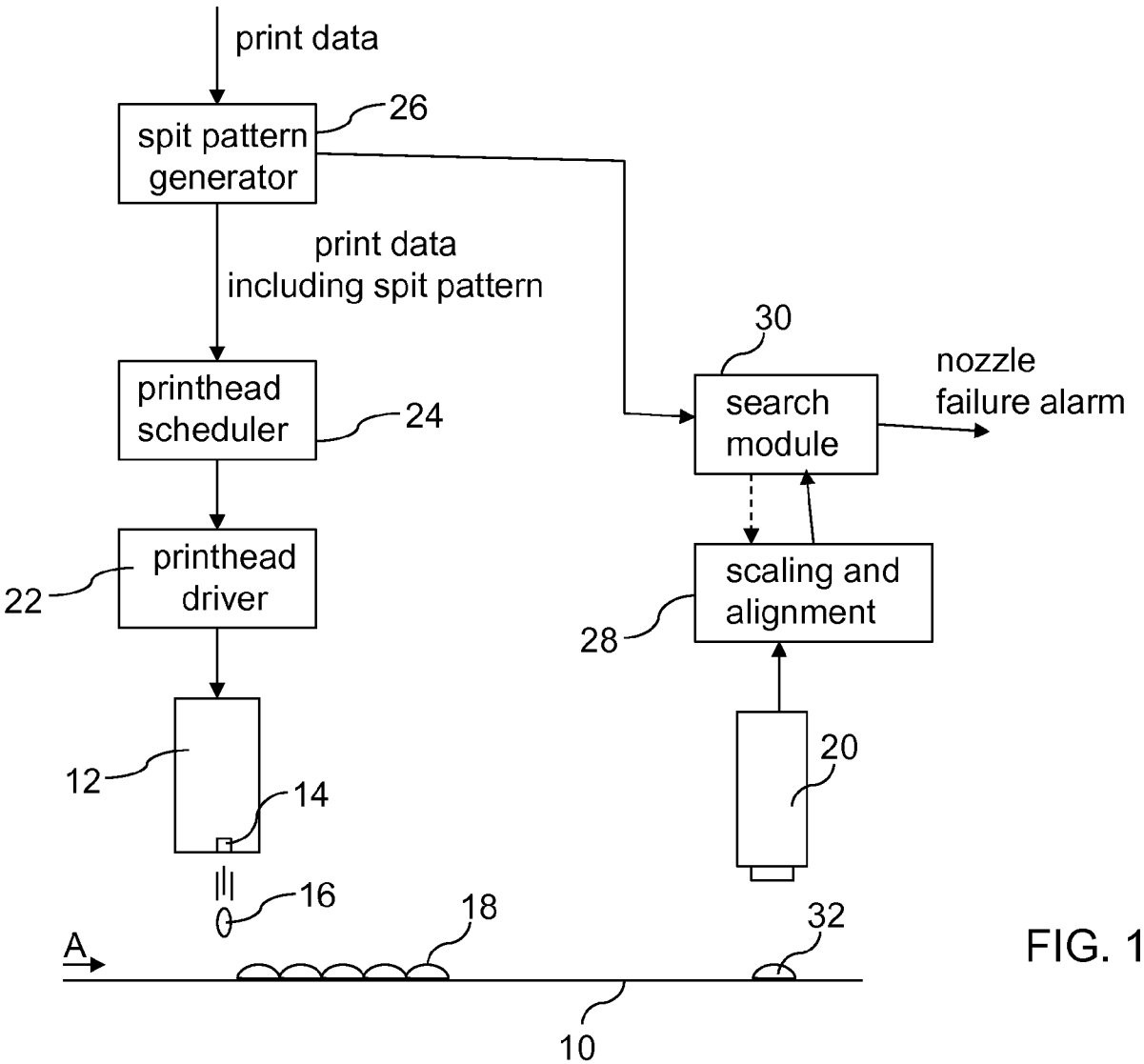
FIG. 1 is a block diagram showing essential parts of an ink jet printer according to the present invention.

The present invention will now be described with reference to the accompanying drawings wherein the same or similar elements have been identified with the same reference numerals.

As is shown in FIG. 1, a recording medium 10, e.g. a sheet of paper, is moved with a constant speed in the direction of an arrow A by means of a transport mechanism, that has not been shown. A print head 12 having a plurality of nozzles 14 is disposed above the path of the recording medium 10 and extends over at least part of the width of the recording medium (in the direction normal to the plane of the drawing in FIG. 1). As is generally known in the art, the nozzles 14 have actuators configured to cause the nozzles to eject ink droplets 16 onto the recording medium 10, so as to print an image composed of ink dots 18 in accordance with print data supplied into the print head. The nozzles 14 are arranged in one or more lines across the width of the recording medium in a certain raster that defines the print resolution, so that, within this raster, an ink dot 18 may be formed in any widthwise position of the recording medium. The positions of the ink dots 18 on the recording medium in the medium transport direction A are determined by the timings at which the individual nozzles are fired when the recording medium 10 moves past the print head. In case of a color printer, the print head 12 will include at least one suitable array of nozzles 14 for each color. A plurality of print heads 12 may be involved for printing a colored image.

A scanner 20 is disposed downstream of the print head 12 in the transport direction A and may be formed by a single-line (monochromatic) CCD-based, CMOS-based or CIS based camera unit that also extends over at least a part of the width of the recording medium 10. When the recording medium 10 moves past the scanner 20, the expected location of an ejected ink dot according to the spit pattern is scanned, so that the presence or absence of an ink dot according to the spit pattern on the location may be verified. In general, when an ink dot should have been printed at an expected location, but cannot be detected with the scanner 20, this indicates that the corresponding nozzle 14 has failed.

Print data that specify the image to be printed are supplied to a print head driver 22, which causes the individual nozzles 14 of the print head to fire at appropriate timings. By way of example, it may be assumed that the nozzles 14 or their actuators are capable of firing synchronously with a certain frequency, so that a pixel line of dots 18 is formed on the recording medium 10 in each cycle. However, other printing strategies may be applied.

In the example shown, the print data are first supplied to a spit pattern generator 26. This spit pattern generator determines a pattern of dots 32 that shall be printed on the recording medium 10, in order to assure that each of the nozzles 14 of the print head will be activated from time to time so as to limit the interval in which the nozzle has been inactive. This interval is selected such that the ink is prevented from drying out in the nozzle and causing a nozzle failure. The spit pattern is included in the print data. The print data including the spit pattern are supplied to a print head scheduler 24, which specifies for each operating cycle of the print head 12, which of the nozzles 14 has to be actuated. The print head scheduler 14 will then send corresponding instructions to the print head driver 22. Further, the print head scheduler 24 sends the information on which nozzle 14 will fire or has fired at which time to the spit pattern generator 26. Instruction signals are sent from the printhead scheduler 24 to the print head driver 22, so that the image that is actually printed with the print head 12 consists of an image specified by the print data including the spit pattern.

The resolution of the scanner 20 may be different from the resolution of the print head 22. This is why the image recorded by the scanner 22 is sent to a scaling and alignment unit 28 where the resolution of the scanner 20 is matched with the resolution of the print head. Further, the scaling and alignment unit 28 may serve for correcting any possible misalignment between the print head and the scanner. In another embodiment, the positions on the scanned image are determined by means of the active scan resolution so that a scaling step is not needed anymore.

The scanned image that has been processed in the scaling and alignment unit 28 is forwarded to a search module 30, which also receives the spit pattern generated by the spit pattern generator 28. The search module 30 searches those areas in the scanned image where a dot 32 should be present according to the spit pattern. When the dot 32 according to the spit pattern is actually found, it is concluded that the nozzle 14 that has printed this dot is still functioning. On the other hand, when no dot 32 according to the spit pattern is found in the search area, it is concluded that the corresponding nozzle has failed, and a nozzle failure alarm is sent to a main control unit of the printer or to an image processing unit for correction purposes, so that the print process may be stopped or measures may be taken for removing or camouflaging the nozzle failure. According to FIG. 1, the search module 30 searches only for the dots 32 that form the spit pattern.

Figure 2:
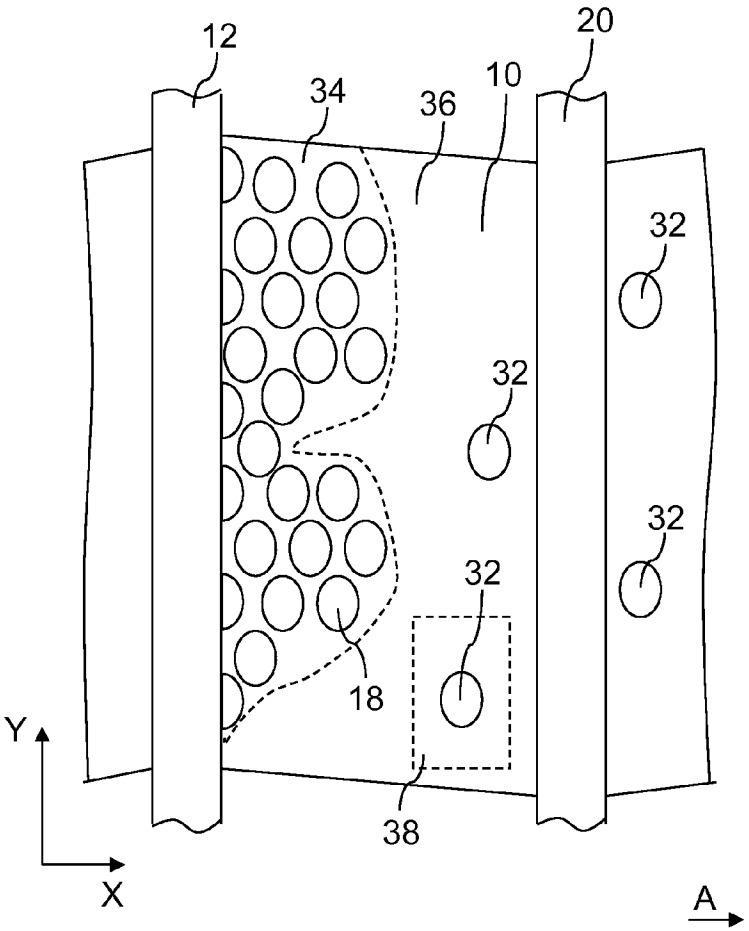
FIG. 2 is a schematic top plan view of parts of a recording medium with a dot pattern thereon and of parts of a print head and a scanner of a printer.

As has schematically been shown in FIG. 2, the print head 12 has printed an image on the recording medium 10. For simplicity, it shall be assumed here that the print head 12 prints only with black ink. A dashed line in FIG. 10 separates an image area 34 on the recording medium 10 from a background area 36. The image area 34 is filled with dots 18 that have been printed in accordance with the print data that is not a part of the spit pattern. The background area 36 is mainly formed by the (white) background of the recording medium, but also includes a spit pattern of loosely scattered dots 32. The positions of the loosely scattered dots 32 have been determined by the spit pattern generator 26 by means of an algorithm, the general principles of which will now be outlined.

Since it is the main purpose of the spit pattern to assure that none of the nozzles 14 remains inactive for an excessively long period of time, regardless of the contents of the print data, the spit pattern generator monitors and stores the history of each of the nozzles 14 and particularly stores the time when each nozzle has printed its last dot. For each nozzle 14, the spit pattern generator 26 may count the time in which the nozzle has been inactive, and when this time reaches a certain limit, the nozzle is scheduled for spitting a dot 32.

However, the constraint is that the dot 32 shall have a predetermined minimum distance from other dots 32 that have already been printed according to the spit pattern, and preferably also from the image area 34. Thus, when two nozzles 14, which are separated only by a small distance in the print head 12, reach the limit of their inactive period approximately at the same time, only one of these nozzles will be activated for printing a dot 32, while the other nozzle will have to wait for a certain time, until the recording medium has been forwarded by a sufficient distance. In this way, it is assured that the dots 32 according to the spit pattern are isolated and do not form any clusters that would be more readily perceptible for the human eye.

The coordinate positions of the dots 32 according to the spit pattern in an x-y-coordinate system or, equivalently, the identities of the nozzles that have printed the dots 32 according to the spit pattern, and the activation times of these nozzles, are transmitted to the search module 30. The search module defines a search area 38 around and including the coordinate position of each dot 32 according to the spit pattern. This search area 38 is dimensioned in view of the expected tolerances of alignment between the print head 12 and the scanner 20 and expected timing errors, so that, when the dot 32 has actually been printed, it will with certainty be found within the search area 38. On the other hand, since the dots 32 according to the spit pattern have a predetermined minimum distance from one another, it is assured that no search area 38 includes more than a single dot 32 having the same color according to the spit pattern. Consequently, it can easily and reliably be verified from each dot 32 that has been included by the spit pattern generator 26 whether this dot has actually been printed or not. When the dot is not found in the search area 38, the nozzle 14 that is responsible for this can be identified reliably and unambiguously, and a corresponding nozzle failure alarm may be delivered.

Optionally, the nozzle failure alarm may also be transmitted to the spit pattern generator 26 to cause the same to activate the defective nozzle more frequently in an attempt to remedy the nozzle failure. This frequency may even be higher than the frequency that would be allowed by the required minimum distance between the dots 32 according to the spit pattern, because, as long as the nozzle fails, the dot according to the spit pattern will not actually be printed.

When an expected dot 32 according to the spit pattern is actually found in the search area 38, but in a position that is offset from the expected position, this offset may be fed back to the scaling and alignment unit for re-calibrating the alignment correction.

Figure 3:
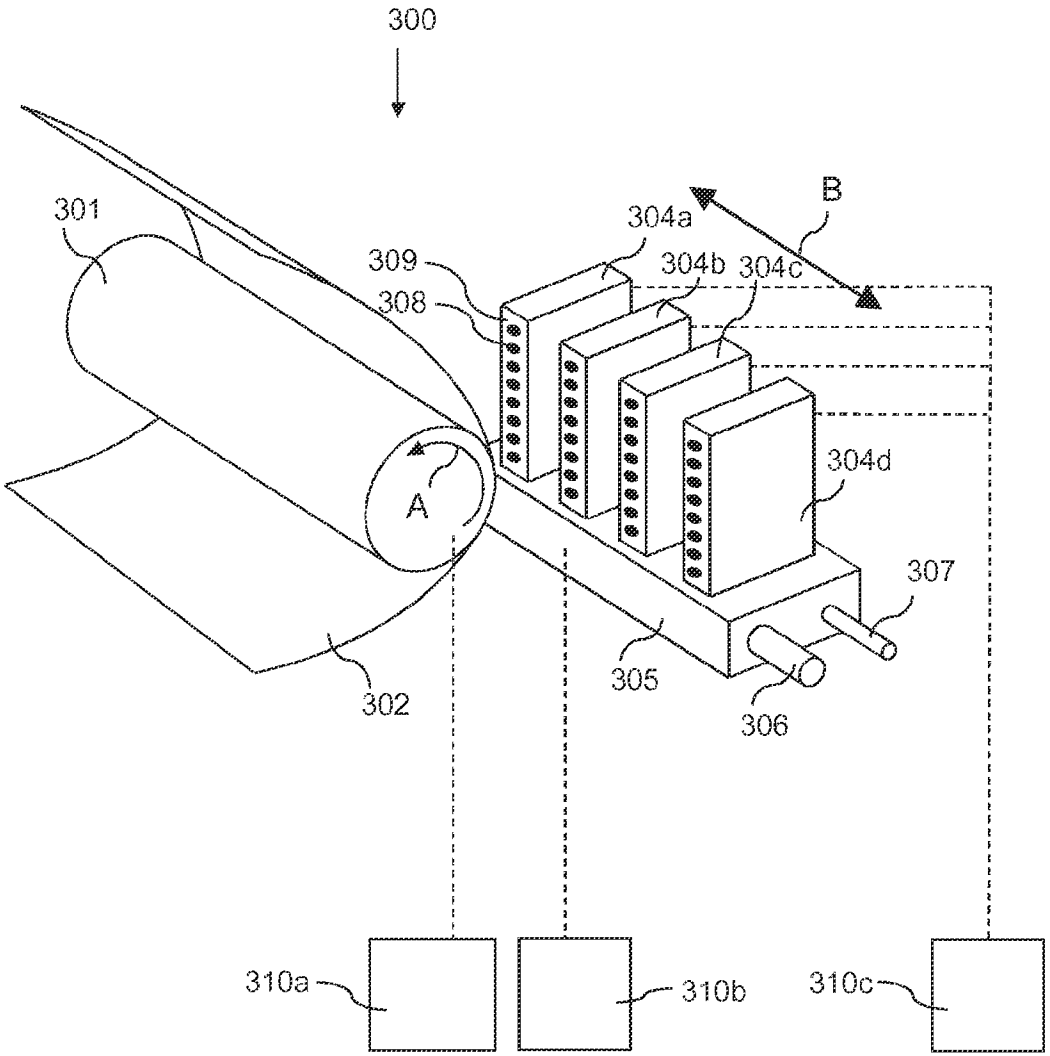
FIG. 3 is an example of an ink jet printing assembly to be placed in a reproduction apparatus according to the present invention.

FIG. 3 shows an ink jet printing assembly 300. The ink jet printing assembly 300 comprises a support for supporting an image receiving member 302. The support is shown in FIG. 3 as a platen 301, but alternatively, the support be a flat surface. The platen 301, as depicted in FIG. 3, is a rotatable drum, which is rotatable about its axis as indicated by arrow A. The support may be optionally provided with suction holes for holding the image receiving member in a fixed position with respect to the support. The ink jet printing assembly 300 comprises print heads 304*a*-304*d*, mounted on a scanning print carriage 305. The scanning print carriage 305 is guided by suitable guides 306, 307 to move in reciprocation in the main scanning direction B. Each print head 304*a*, 304*b*, 304*c*, 304*d* comprises an orifice surface 309, which orifice surface 309 is provided with at least one orifice 308. The print heads 304*a*-304*d* are configured to eject droplets of functional material onto the image receiving member 302. The platen 301, the carriage 305 and the print heads 304*a*-304*d* are controlled by suitable controls 310*a*, 310*b* and 310*c*, respectively. A detector for detecting failing print elements may be integrated at the print heads 304*a*-304*d*, or may be mounted on the carriage 305 as a scanner, which is configured to scan the just ejected functional material dots.

The image receiving member 302 may be a medium in web or in sheet form and may be composed of, e.g. paper, cardboard, label stock, coated paper, plastic or textile. Alternatively, the image receiving member 302 may also be an intermediate member, endless or not. Examples of endless members, which may be moved cyclically, are a belt or a drum. The image receiving member 302 is moved in the sub-scanning direction A by the platen 301 along four print heads 304*a*-304*d* provided with a fluid functional material.

A scanning print carriage 305 carries the four print heads 304*a*-304*d* and may be moved in reciprocation in the main scanning direction B parallel to the platen 301, such as to enable scanning of the image receiving member 302 in the main scanning direction B. Only four print heads 304*a*-304*d* are depicted for demonstrating the present invention. In practice, an arbitrary number of print heads may be employed. In any case, at least one print head 304*a*, 304*b*, 304*c*, 304*d* per color of functional material is placed on the scanning print carriage 305. For example, for a black-and-white printer, at least one print head 304*a*, 304*b*, 304*c*, 304*d*, usually containing black functional material is present. Alternatively, a black-and-white printer may comprise a white functional material, which is to be applied on a black image-receiving member 302. For a full-color printer, containing multiple colors, at least one print head 304*a*, 304*b*, 304*c*, 304*d* for each of the colors, usually black, cyan, magenta and yellow is present. Often, in a full-color printer, black functional material is used more frequently in comparison to differently colored functional material. Therefore, more print heads 304*a*-304*d* containing black functional material may be provided on the scanning print carriage 305 compared to print heads 304*a*-304*d* containing functional material in any of the other colors. Alternatively, the print head 304*a*, 304*b*, 304*c*, 304*d* containing black functional material may be larger than any of the print heads 304*a*-304*d*, containing a differently colored functional material.

The carriage 305 is guided by guides 306, 307. These guides 306, 307 may be rods as depicted in FIG. 3. The rods may be driven by suitable drives (not shown). Alternatively, the carriage 305 may be guided by other guides, such as an arm being able to move the carriage 305. Another alternative is to move the image receiving material 302 in the main scanning direction B.

The apparatus may also be embodied with a non-scanning page-wide print carriage 305. The receiving material moves under the print carriage 305, while the print carriage 305 is not moved in any direction. Such an apparatus usually applies a single pass strategy. Since the print carriage 305 is page-wide, on every image scan-line in the direction of the movement of the receiving material, functional material is ejected by at least one print element.

Each print head 304*a*, 304*b*, 304*c*, 304*d* comprises an orifice surface 309 having at least one orifice 308, in fluid communication with a pressure chamber containing fluid functional material provided in the print head 304*a*, 304*b*, 304*c*, 304*d*. On the orifice surface 309, a number of orifices 308 is arranged in a single linear array parallel to the sub-scanning direction A. Eight orifices 308 per print head 304*a*, 304*b*, 304*c*, 304*d* are depicted in FIG. 3, however obviously in a practical embodiment several hundreds of orifices 308 may be provided per print head 304*a*, 304*b*, 304*c*, 304*d*, optionally arranged in multiple arrays. As depicted in FIG. 3, the respective print heads 304*a*-304*d* are placed parallel to each other such that corresponding orifices 308 of the respective print heads 304*a*-304*d* are positioned in-line in the main scanning direction B. This means that a line of image dots in the main scanning direction B may be formed by selectively activating up to four orifices 308, each of them being part of a different print head 304*a*, 304*b*, 304*c*, 304*d*. This parallel positioning of the print heads 304*a*-304*d* with corresponding in-line placement of the orifices 308 is advantageous to increase productivity and/or improve print quality. Alternatively, multiple print heads 304*a*-304*d* may be placed on the print carriage adjacent to each other such that the orifices 308 of the respective print heads 304*a*-304*d* are positioned in a staggered configuration instead of in-line. For instance, this may be done to increase the print resolution or to enlarge the effective print area, which may be addressed in a single scan in the main scanning direction. The image dots are formed by ejecting droplets of functional material from the orifices 308. Each of the orifices 308, except an orifice at an end of the inkjet printing assembly, has a left neighbor in the main scanning direction and a right neighbor in the main scanning direction.

Upon ejection of the functional material, some functional material may be spilled and stay on the orifice surface 309 of the print head 304*a*, 304*b*, 304*c*, 304*d*. The ink present on the orifice surface 309 may negatively influence the ejection of droplets and the placement of these droplets on the image receiving member 302. Therefore, it may be advantageous to remove excess ink from the orifice surface 309. The excess ink may be removed, for example by wiping with a wiper and/or by application of a suitable anti-wetting property of the surface, e.g. provided by a coating.

The reproduction apparatus may be an inkjet printer comprising a print head according to FIG. 3. A functional material may be an aqueous ink, a liquid ink, a paste ink, a powder ink, UV curable ink, a hot melt ink, toner, plastic, wood, glass, ceramic, epoxy material, or a metal, like copper, silver, etc. besides other functional materials. The receiving medium may be paper, corrugated plastic such as coroplast, plastic sheets such as Gatorplast®, polycarbonate, scrim banner, or polystyrene (even black polystyrene), fabric or any other form of substrate.

Figure 4B:
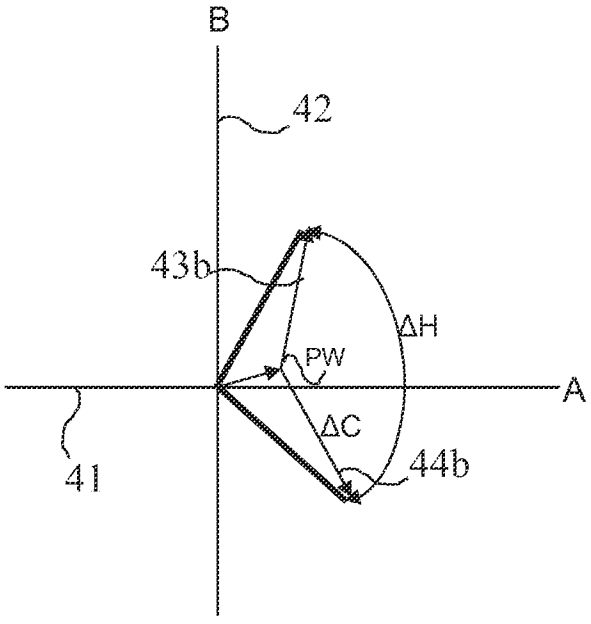
FIG. 4B is a schematic diagram of a part of an L*a*b* color vector space comprising a vector with a chroma component and hue component and a vector indicating the paper white.
Figure 4A:
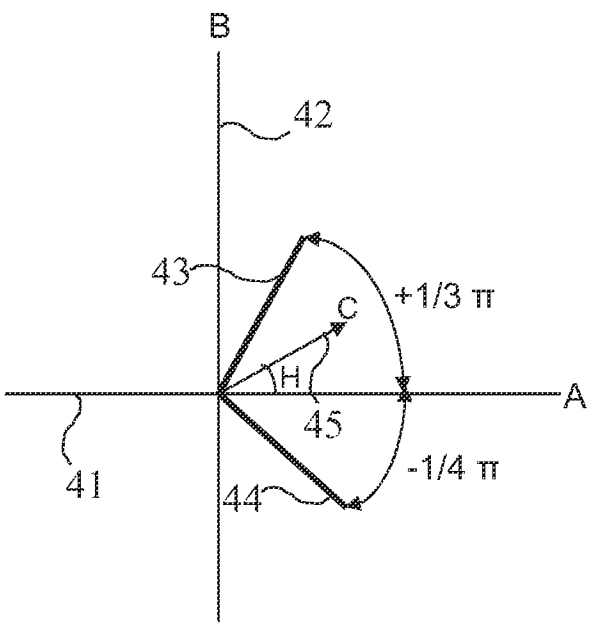
FIG. 4A is a schematic diagram of a part of an L*a*b* color vector space comprising a vector with a chroma component and hue component.

FIG. 4A shows schematically a diagram of an L*a*b* color vector space projected on two ordinates A and B. A circle segment area is shown with a hue angle range from −45° (−¼π radians) to +60° (+⅓π radians) in combination with a chroma threshold characterized by a length of a line piece 43 equaling a length of a line piece 44. A measured vector 45 is shown having a hue value H and a chroma value C. The circle segment area represents colors defined as Magenta. Since the measured vector 45 falls within the circle segment area, the measured vector will be determined to have a Magenta color. Another circle segment area is defined for Cyan having a hue angle range from −180° (−π radians) to −30° (+⅙π radians) in combination with a chroma threshold XC). Another circle segment area is defined for Yellow having a hue angle range from +45° (¼π radians) to +135° (+⅔π radians) in combination with a chroma threshold XY).

It should be noted that the hue angle range of Magenta overlaps with the hue angle range of Cyan and with the hue angle range of Yellow. Colors in the overlap areas can still be distinguished from each other by using the chroma threshold value in combination with the hue angle range.

FIG. 4B shows schematically a diagram of an L*a*b* color vector space projected on two ordinates A and B including a point PW indicating the paper white. A circle segment area is shown with a hue angle range ΔH in combination with a chroma threshold ΔC characterized by a length of a line piece 43*b* equaling a length of a line piece 44*b*. A measured vector (not shown) having a hue value H and a chroma value C falling within the circle segment area, will be determined to have a Magenta color.

Figure 5:
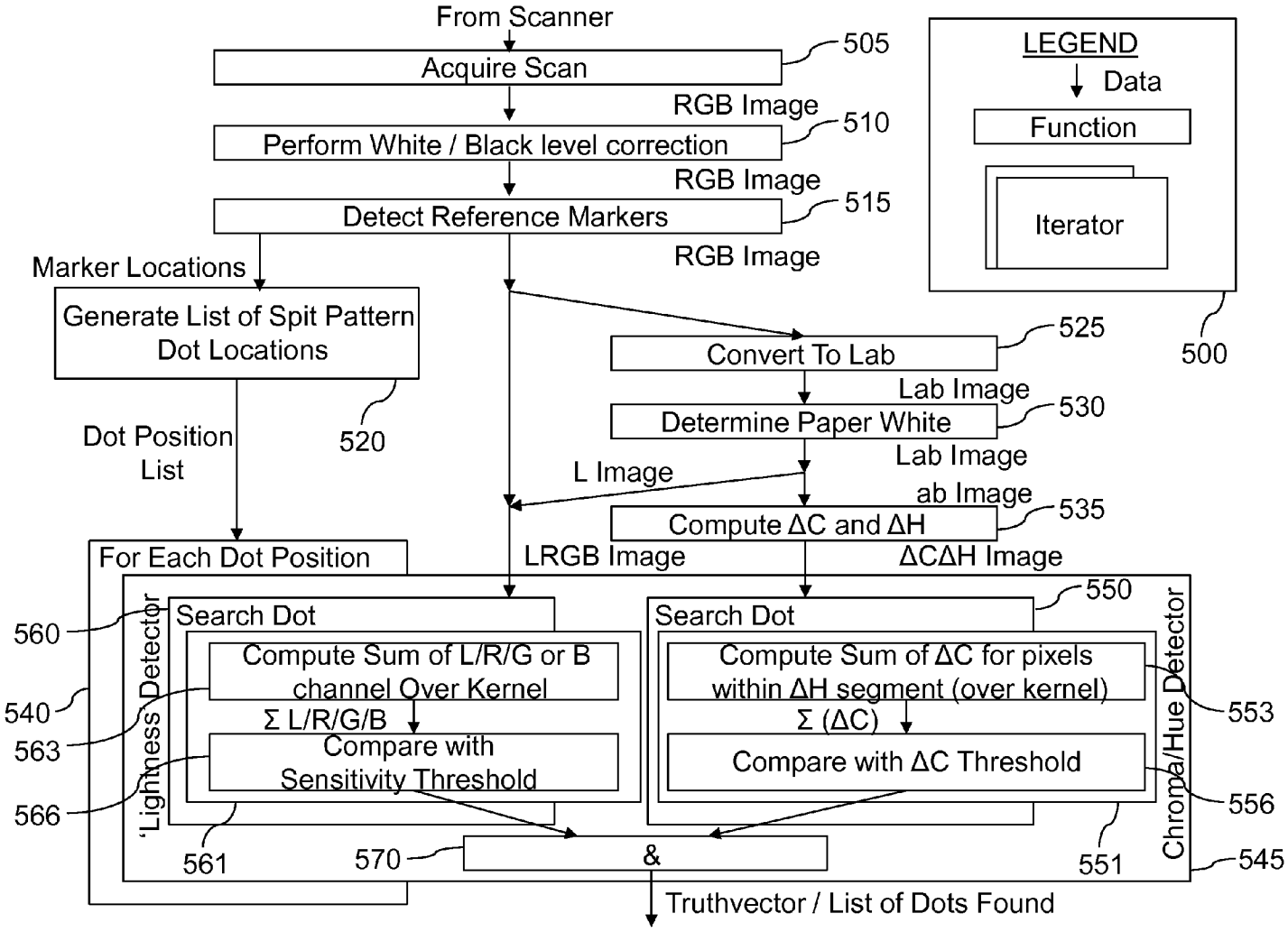
FIG. 5 is a flow diagram of an embodiment of the method according to the present invention.

FIG. 5 shows a flow diagram of an embodiment of the method according to the present invention.

A legend 500 is shown with a visualization of data by an arrow, of a function or a step by a rectangle and an iterator by two overlapping rectangles.

According to a first step 505, a scanner scans a just printed part of the document and creates a scan file from a just printed part of a document on a medium. The part may also be a complete sheet. The scan file is created while printing the document. The just printed part of the document comprises at least a part of a background spit pattern consisting of colored dots, which are intended to be isolated on the medium from the other dots. According to this embodiment, the scanner delivers an RGB image. The RGB image consists of a matrix of pixels each having RGB-values.

According to a second step 510, a known white-black correction is applied upon the values of the pixels of the RGB image. Such a white-black correction may be dependent on the color of the medium that has been scanned by the scanner or may be dependent on the light circumstances of the environment of the scanner. This second step 510 delivers an RGB image derived from the image created in the first step 505.

According to a third step 515, reference markers of the background spit pattern are detected and their locations are established. When a test page is used, reference markers may be printed on the test page during printing of the test page. When printing a regular image, characteristics of the image data may be used instead of reference markers.

According to a fourth step 520, locations of the reference markers are used to generate a list of spit pattern dot locations.

According to a fifth step 525, the RGB image is converted to a L*a*b* image according to a known conversion of an RGB color space to an L*a*b* color space.

According to a sixth step 530, a paper white value is determined by means of the L*a*b* image. The lightness component L is stripped of the L*a*b* image delivering an ab image and an L image. The L image is united with the RGB image delivering an LRGB image consisting of four separate channels L, R, G and B.

The ab image is input for a seventh step 535, which computes a delta chroma value ΔC and a delta hue value ΔH. Each delta value is a difference between the original value and the corresponding paper white component value. The seventh step 535 delivers a ΔCΔH image.

The list of spit pattern dot locations, the LRGB image and the ΔCΔH image are used for input in a first iteration process 540 for each dot location.

The first iteration process 540 consists of a first process block 545 comprising a second iteration process 560 and a third iteration process 550 for each dot location. The second iteration process 560 and the third iteration process 550 may be parallel processed, since the output of both processes is needed for an AND step 570.

The dot location consists of a kernel area of a predetermined size of x by y scan pixels, wherein x=y=3 for example. The dot location is shifted along a larger area of, for example 5×7 pixels, comprising the initial 3×3 kernel area. The size of the larger area may be selected dependent on a used resolution of the scanner. Larger areas used to search for different dot locations may overlap. For each dot location, the second iteration process 560 and the third iteration process 550 are started.

The LRGB image is used for input in the second iteration process 560, also indicated as a lightness detector. The second iteration process 560 consists of a process block 561 comprising a seventh step 563 and an eighth step 566 to be executed for each dot location. According to the seventh step 563, an L value, an R value, a G value or a B value is respectively summarized over the kernel pixels. According to the eighth step 566, each summarized value ΣL, ΣR, ΣG or ΣB is compared to a sensitivity threshold, which is predetermined according to the method. Such a predetermined sensitivity threshold may be set per channel L, R, G, B. The eighth step 566 delivers a first bit value 1 or 0 if the summarized value exceeds the sensitivity threshold or not, respectively.

The ΔCΔH image is used for input in the third iteration process 550, also indicated as a chroma/hue detector. The third iteration process 550 consists of a process block 551 comprising a ninth step 553 and a tenth step 556 to be executed for each dot location. According to the ninth step 553 a ΔC value is summarized over the kernel pixels, which are lying within the ΔH hue angle range according to FIG. 4. According to the tenth step 556, the summarized value ΣΔC is compared to a ΔC threshold, which is predetermined and calibrated. A calibration may be executed, which has been balanced with respect to false positives and false negatives, meaning in this invention, dots considered present that are not and dots considered not present which are, respectively. Such a predetermined sensitivity threshold may be set per combination of a color of the functional material, which has been ejected on the medium, for example Cyan, Black, Magenta and Yellow, and a type of medium used to eject drops upon. The tenth step 556 delivers a second bit value 1 or 0, if the summarized value exceeds the ΔC threshold or not, respectively.

According to an eleventh step 570, the first and second bit are AND-ed (&) for each dot location, according to a well-known bit-operation. The result is a truth vector. From the truth vector, a list of dots is derived that are considered present.

Overall, a dot is only considered present when both the lightness detector 560 and the chroma/hue detector 550 both return a positive result (1) at the same dot location. This allows the lightness detector 560 to operate in a very sensitive setting, since the chroma/hue detector 550 will now reject most locations where the paper fiber triggers the lightness detector.

Since black is a neutral color without a strong chroma component, the above described chroma/hue detector does not improve the detection results for black dots. However, for black, the chroma/hue detector does not have to be disabled if the chroma threshold is set low enough. When the chroma threshold is set low enough, the chroma/hue detector 550 always returns a positive result (1), and the overall result becomes just the output of the lightness detector 560.

To further improve the performance of the chroma/hue detector, the chroma/hue detector is adapted by means of the seventh step 535, so that it is using not the true chroma value and the true hue value of a pixel, but rather the ΔC value and the ΔH hue angle relative to paper white. The location of paper white may be determined by building a histogram of each scan, and deriving the point of paper white from the histogram. The location of paper white may also be determined by building histograms on parts of the scanned image, to correct for small changes in paper white within the scanned image.

With this adapted chroma/hue detection, it is possible to detect combinations of functional material and media, that were nearly undetectable before. For instance, a mean time between a failure value of the first process block 545 may be improved by a significant factor due to a selected detection scenario.

The chroma/hue detector 550 may be implemented in software, as part of an overall nozzle failure detection system. Experiments by the inventor have shown that, despite limited optimization only, the method according to the present invention is fast enough to keep up with a print engine having a print velocity of a transport of 1.25 meter per second, or 5 A4 format cut sheets per second and an ejection frequency of approximately 300 Khz.

It is noted that not only the chroma/hue detector 550 itself, but also the conversion step 525 from RGB to L*a*b*, the white point detection (on a and b input channel values) step 530 and the conversion 535 to the ΔC values and the ΔH values are all combined with the chroma/hue detection 550.

It is also noted that the lightness detector 560 only operates on the L values when detecting black functional material. It may still operates on the RGB input channel values, as the inventor has found that the L values as well as the R, G and B values may be used for lightness detection. This result even holds for black functional material.

The invention may be applied to any printer, for example an inkjet printer that is suitable to monitor printing element health through the use of an inline scanner or an offline scanner.

It is noted that the term functional material is used for the material that is to be ejected on the receiving material. Functional material also includes functional material in the sense that the functional material may form drops on the receiving material which form features on the receiving material which have a function. The function may be related to the use or purpose of the printed end product. Such a function may be, besides a marking function, an isolating function, a conducting function or any other function related to the use or purpose of the printed end product. Functional material for the marking function may be hot melt ink, UV curable ink, water based ink and toner. Functional material for an isolating function may be an isolating material like wood, glass, ceramic and epoxy material. Functional material for a conducting function may be a conducting material as metal, like copper, silver, etc.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for detecting a dot of functional material on a medium at a predetermined location, the dot having a predetermined color, wherein the method comprises the steps of:

determining an environment of the predetermined location, comprising a plurality of pixels surrounding the predetermined location and including the predetermined location itself;

scanning the environment resulting in scanning values for each pixel of the environment; for each pixel of the environment, establishing a value for a lightness component of a color of the pixel derived from the scanning values;

for each pixel of the environment, establishing a chroma value for a chroma component of a color of the pixel derived from the scanning values;

summarizing the chroma values of the pixels of the environment into a summarized chroma value for the environment;

summarizing the lightness values of the pixels of the environment into a summarized lightness value for the environment;

comparing the summarized chroma value to a predetermined chroma threshold value dedicated for the predetermined color of the dot;

comparing the summarized lightness value to a predetermined lightness threshold value dedicated for the predetermined color of the dot;

deciding whether or not the dot is present in the environment based on the steps of comparing the summarized chroma value and comparing the summarized lightness value; and for each pixel of the environment, establishing a hue value for a hue component of a color of the pixel derived from the scanning values, wherein in the step of summarizing the chroma values, only chroma values of the pixels of the environment having a hue value for the hue component of the color of the pixel within a predetermined hue angle range dedicated for the predetermined color of the dot are summarized, and wherein the dot is part of a background spit pattern designed with respect to detection of a failure of a printing element in a color image reproduction apparatus, said printing element being suitable to eject the dot.

2. The method according to claim 1, further comprising the step of individually setting a chroma threshold and a hue angle range for each combination of a type of medium and a color of the functional material.

3. The method according to claim 1, further comprising the steps of:

using a difference vector (ΔC) of a chroma value of a dot and a chroma value of the medium, instead of the established chroma value; and using a difference vector (ΔH) of a hue value of the dot and a hue value of the medium, instead of the established hue value.

4. The method according to claim 1, further comprising the step of shifting the environment around in a larger area than the determined environment, said larger area including the determined environment, in order to search for a dot in the shifted environment.

5. A method for detecting a plurality of dots of functional material on a medium at a predetermined location, each of the plurality of dots having a predetermined color, comprising the step of detecting each of the plurality of dots according to claim 1.

6. A computer program embodied on a non-transitory computer readable medium and comprising computer program code to enable a color image reproduction apparatus to execute the method according to claim 1.

7. A color image reproduction apparatus comprising:

printing elements for ejecting colored dots of functional material according to a digital color image on a medium having a medium color;

a scanner configured to scan a location on the medium resulting in a scanned color;

a first establishing mechanism configured to establish a lightness component of the scanned color;

a second establishing mechanism configured to establish a chroma component of the scanned color;

a third establishing mechanism configured to establish a hue component of the scanned color; and a decision mechanism configured to decide whether a colored dot is present on the medium in an environment of a location of the medium, the location being present in a list of predetermined dot locations residing in a memory of the color image reproduction apparatus, the colored dot having a predetermined color, wherein a decision taken by the decision mechanism is based on each value of the established components of the scanned color by comparing a value of the lightness component to a predetermined lightness threshold value dedicated for the predetermined color of the colored dot, and comparing a value of the chroma component to a predetermined chroma threshold value dedicated for the predetermined color of the colored dot, wherein the value of the chroma component is obtained by summarizing only chroma values of the pixels of the environment having a hue value for the hue component of the scanned color within a predetermined hue angle range dedicated for the predetermined color of the colored dot.

* * * * *